US008129637B2

(12) United States Patent
Morrison et al.

(10) Patent No.: US 8,129,637 B2
(45) Date of Patent: Mar. 6, 2012

(54) SWITCH MECHANISM

(75) Inventors: Scott Morrison, Howell, MI (US); Todd List, Keego Harbor, MI (US); Paul McEvilly, Farmington Hills, MI (US)

(73) Assignee: TRW Automotive U.S. LLC, Livonia, MI (US)

( * ) Notice: Subject to any disclaimer, the term of this patent is extended or adjusted under 35 U.S.C. 154(b) by 460 days.

(21) Appl. No.: 12/321,721

(22) Filed: Jan. 23, 2009

(65) Prior Publication Data

US 2010/0187083 A1 Jul. 29, 2010

(51) Int. Cl.
*H01H 9/00* (2006.01)

(52) U.S. Cl. ..... 200/5 R; 200/4; 200/14; 200/18

(58) Field of Classification Search ..... 200/5 R, 200/5 A, 4, 14, 17 R, 18; 341/20, 22, 35; 345/168, 169, 184, 156, 160, 161
See application file for complete search history.

(56) References Cited

U.S. PATENT DOCUMENTS 4,034,574 A 7/1977 Kuder
(Continued)

*Primary Examiner* — Michael Friedhofer
(74) *Attorney, Agent, or Firm* — Tarolli, Sundheim, Covell & Tummino LLP

(57) ABSTRACT

A switch mechanism includes a support; a plurality of switches connected to the support. An encoder rotatable about an axis of a shaft; an actuator rotatable with the shaft and tiltable relative to the shaft; and a connector assembly interconnecting the actuator and the shaft to transmit rotational movement of the actuator to the shaft and permits tilting of the actuator. Each of the switches has a central axis and an upper surface to actuate the switch. A lever engages the upper surface at a first location on the central axis and pivotably engages actuator at a second location. The pivot axis is spaced from the first location a first vertical distance parallel to the central axis. The second location is spaced from the first location a second vertical distance parallel to the central axis 52. The first distance D1 is smaller than the second distance D2.

29 Claims, 4 Drawing Sheets

U.S. PATENT DOCUMENTS 4,136,270 A 1/1979 Wernet et al.
4,362,916 A 12/1982 Anderson
4,789,377 A 12/1988 Hoskins
4,803,316 A 2/1989 Hayashi et al.
5,513,999 A 5/1996 Fry et al.
5,569,090 A 10/1996 Hoskins et al.
5,622,254 A 4/1997 Lee
5,627,448 A 5/1997 Okada et al.
5,631,453 A * 5/1997 Maeda ..... 200/6 A
5,714,732 A 2/1998 Lee
5,834,714 A 11/1998 Berger et al.
5,952,628 A * 9/1999 Sato et al. ..... 200/4
6,102,725 A 8/2000 Panagiotou
6,265,680 B1 7/2001 Robertson
6,352,477 B1 * 3/2002 Soma et al. ..... 463/36
6,621,017 B2 * 9/2003 Shibutani et al. ..... 200/5 A
6,787,716 B1 * 9/2004 Menche ..... 200/6 A
6,812,415 B1 11/2004 Priesemuth
6,953,900 B2 * 10/2005 Sottong ..... 200/5 R
7,087,848 B1 8/2006 Yamasaki et al.
7,091,430 B1 8/2006 Haizima et al.
7,232,965 B2 * 6/2007 Gibbons et al. ..... 200/17 R
2005/0162389 A1 * 7/2005 Obermeyer et al. ..... 345/161
2005/0284737 A1 12/2005 Shitanaka et al.
2009/0072816 A1 * 3/2009 Schrubbe et al. ..... 324/207.2

* cited by examiner

SWITCH MECHANISM

TECHNICAL FIELD

The present invention relates to a switch mechanism, and more specifically, to a switch mechanism for controlling various electronic devices of a vehicle.

BACKGROUND OF THE INVENTION

A switch mechanism generally includes a rotatable actuator. The switch mechanism sends a first signal in response to rotation of the actuator. The actuator may be tilted to actuate a switch of the switch mechanism. The switch mechanism sends a second signal upon actuation of the switch.

SUMMARY OF THE INVENTION

The present invention relates to a switch mechanism. In a first aspect, the switch mechanism includes a support and a plurality of switches connected to the support. An encoder connected to the support has a shaft rotatable about an axis of the shaft relative to the support. The encoder sends signal in response to a sensed rotational position of the shaft about the axis relative to the support. An actuator is rotatable with the shaft about the axis of the shaft relative to the support and tiltable relative to the axis of the shaft to actuate any of the plurality of switches when the shaft is in any rotational position relative to the support. A connector assembly interconnects the actuator and the shaft. The connector assembly transmits rotational movement of the actuator to the shaft and permits tilting movement of the actuator relative to the axis.

In another aspect of the present invention, a switch mechanism includes an actuator and a switch having a central axis. An upper surface of the switch moves to actuate the switch. A lever is pivotal about a pivot axis. The lever has a lower surface engaging the upper surface of the switch at a first location on the central axis. The actuator engages an upper surface of the lever at a second location to pivot the lever toward the upper surface of the switch to actuate the switch. The pivot axis is spaced from the first location a first vertical distance extending parallel to the central axis of the switch. The second location is spaced from the first location a second vertical distance in a direction extending parallel to the central axis. The first distance is smaller than the second distance.

BRIEF DESCRIPTION OF THE DRAWINGS

The foregoing and other features of the present invention will become apparent to those skilled in the art to which the present invention relates upon reading the following description with reference to the accompanying drawings, in which.

DESCRIPTION OF AN EXEMPLARY EMBODIMENT

Figure 1:
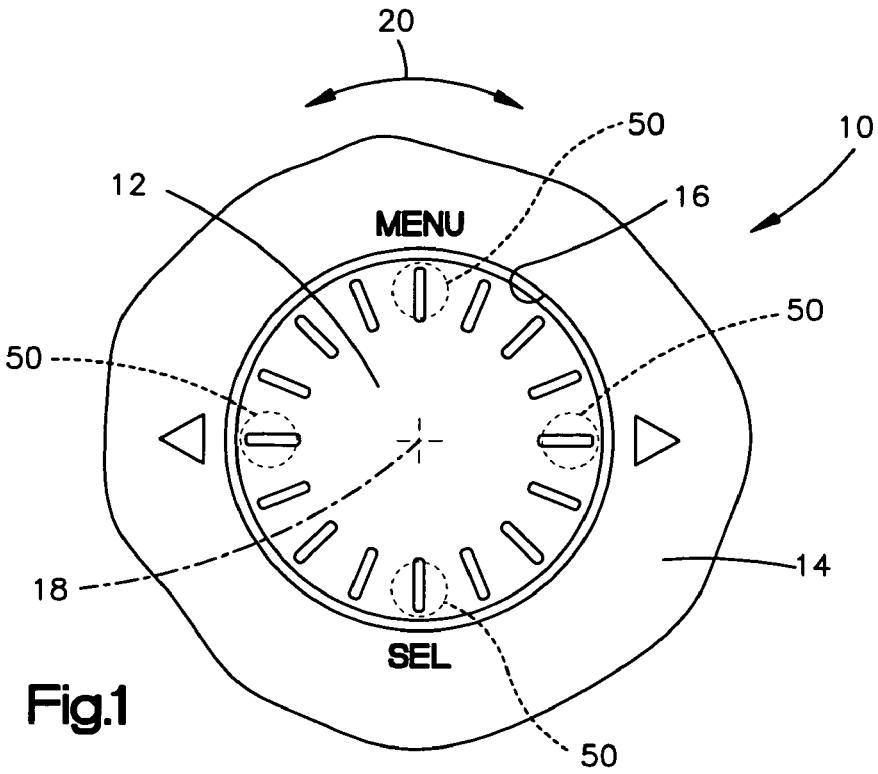
FIG. 1 is a schematic plan view of a switch mechanism constructed in accordance with a first exemplary embodiment of the present invention.
Figure 3:
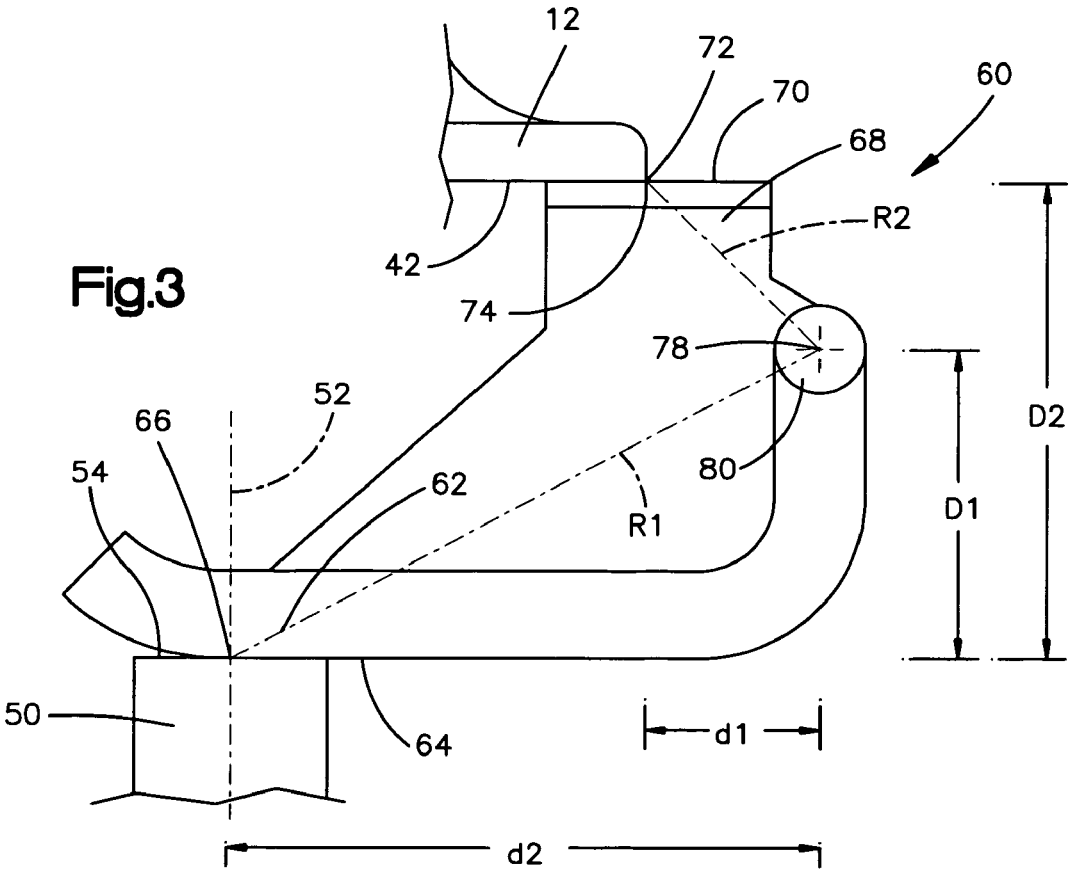
FIG. 3 is an enlarged schematic view of a lever of the switch mechanism of FIG. 1.
Figure 2:
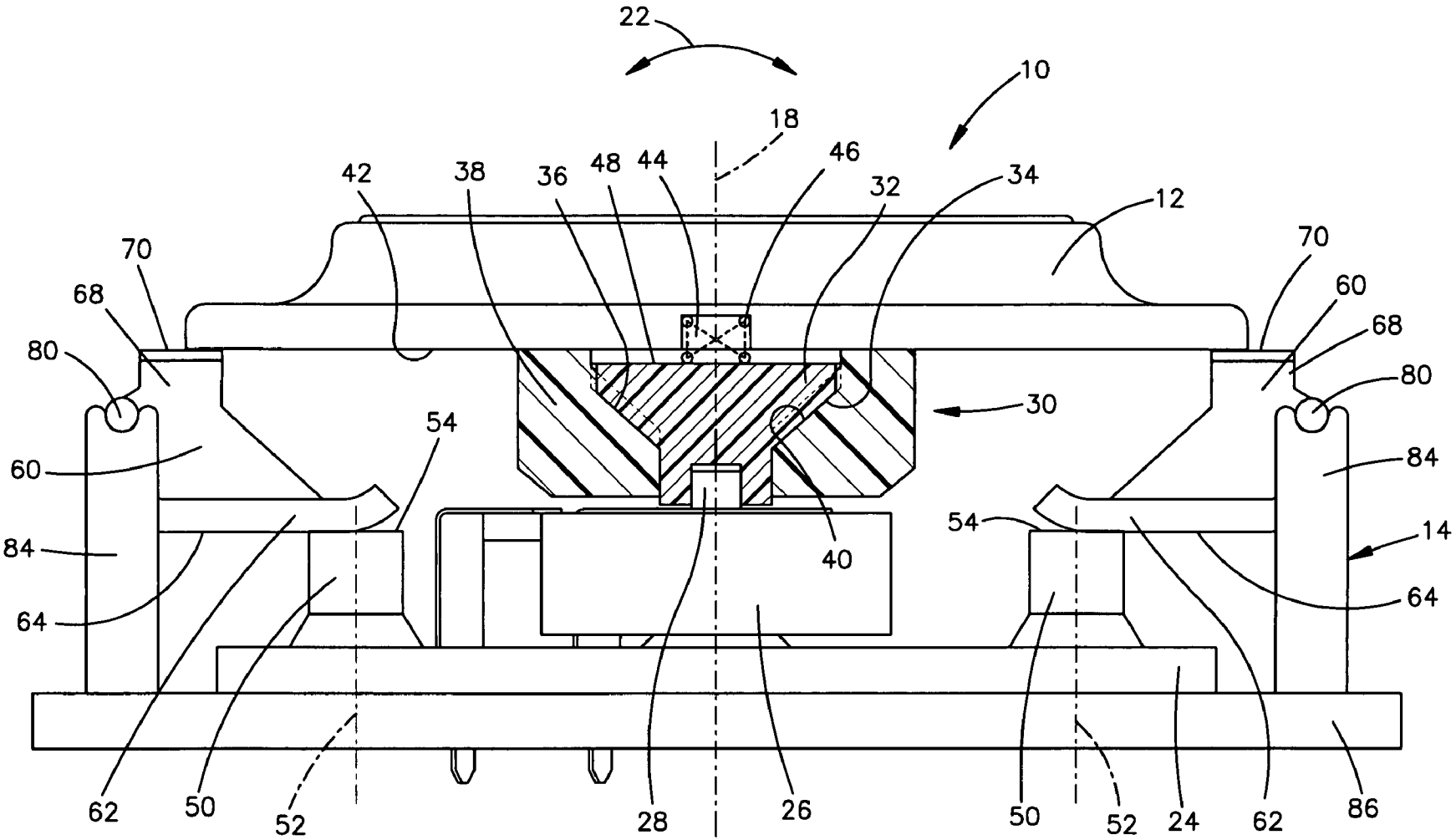
FIG. 2 is a schematic sectional view of the switch mechanism of FIG. 1.

A switch mechanism 10 constructed in accordance with a first exemplary embodiment of the present invention is illustrated in FIGS. 1-3. The switch mechanism 10 may be used to control various vehicle electronic devices, such as, lights, audio equipment, mirrors, climate control system, or navigation system. The switch mechanism 10 may permit a user to scroll through menus and select the electronic device or function to be controlled by the switch mechanism. The switch mechanism 10 may be mounted in a vehicle in any desired location, such as a vehicle steering wheel or dashboard.

The switch mechanism 10 includes a manually engageable actuator 12 and a housing 14. The actuator 12 extends through an opening 16 in the housing 14. The actuator 12 is rotatable about an axis 18 relative to the housing 14 as indicated by the arrows 20 in FIG. 1. The actuator 12 may also be tilted in any direction relative to the axis 18 as indicated by the arrows 22 in FIG. 2. The actuator 12 may be tilted in any direction relative to the axis 18 when the actuator is in any rotational position relative to the axis 18. The actuator 12 may be rotated relative to the housing 14 to scroll through a menu, such as a menu of electronic devices or a menu of controls for an electronic device. The actuator 12 may be tilted relative to the axis 16 to select a choice from the menu or operate an electronic device.

A support or printed circuit board (PCB) 24 (FIG. 2) supports the actuator 12 for rotation relative to the housing 14 and for tilting relative to the axis 18. An encoder 26 is mounted on the PCB 24. An input shaft 28 of the encoder 26 is connected with the actuator 12 by a connector assembly 30. Accordingly, rotation of the actuator 12 relative to the support or PCB 24 and the housing 14 rotates the shaft 28 of the encoder 26. The encoder 26 senses a rotational position of the shaft 28 and the actuator 12 and sends a signal to an electronic control unit (not shown) in a known manner.

The connector assembly 30 (FIG. 2) includes a conical gear 32 connected to the shaft 28. The gear 32 is press fit onto the shaft 28 to rotate with the shaft. However, the gear 32 may be connected to the shaft 28 in any desired manner. The gear 32 is spaced axially from the actuator 12. The gear 32 includes exterior conical teeth 34 that mesh with conical teeth 36 of a gear 38. The conical teeth 36 of the gear 38 define an axially extending opening 40 through which the conical gear 32 extends. The gear 38 is fixedly connected with the actuator 12. The gear 38 and the actuator 12 have a snap connection. However, the gear 38 may be connected to the actuator 12 in any desired manner. The conical gear 32 and the shaft 28 rotate relative to the PCB 24 upon rotation of the actuator 12 and the gear 38.

The actuator 12 has a lower surface 42 with a recess 44. A spring 46, such as a coil spring, extends into the recess 44. The spring 46 engages the actuator 12 and an upper surface 48 of the gear 32. The spring 46 urges the gears 32 and 38 axially toward each other so that the teeth 34 and 36 of the gears 32 and 38 engage each other. Accordingly, the spring 46 urges the actuator 12 into an initial position in alignment with the axis 18. The spring 46 also urges the gear 32 axially away from the actuator 12 so that the upper surface 46 of the gear 32 is spaced from the actuator when no axial force is applied to the actuator. The space between the actuator 12 and the gear 32 permits tilting movement of the actuator and gear 38 relative to shaft 28 and the gear 32. When the actuator 12 is tilted relative to the axis 18, the teeth 34 and 36 of the gears 32 and 38 on the side of the gears toward which the actuator tilts may disengage from each other to permit tilting movement of the actuator.

The support or PCB 24 includes a plurality of switches 50 that may be activated by tilting of the actuator 12 relative to the shaft 28. The PCB 24 includes four switches 50 (FIG. 1) equally spaced about the axis 18. Accordingly, the switches 50 may be located at 90° relative to each other. The PCB 24 may include any number of switches 50 that are spaced apart in any desired manner about the axis 18.

Each of the switches 50 may be a dome switch having a central axis 52. The switches 50 may be actuated to control an electronic device or make a selection from a menu. The switches 50 send a signal to the electronic control unit (not shown) when actuated. Each switch 50 has an upper surface 54, as viewed in FIGS. 2 and 3. The switch 50 is actuated by depressing the upper surface 54 to control an electronic device or make a selection from a menu.

A plurality of levers 60 (FIG. 2) engage the upper surfaces 54 of the switches 50. Each of the levers 60 (FIG. 3) has a lower portion 62, as viewed in FIG. 3, with a lower surface 64 engaging the upper surface 54 of the switch 50. The lower surface 64 engages the upper surface 54 at a switch engagement location 66 defined as the intersection of the central axis 52 of the switch 50 and the lower surface 64. Upon pivotal movement of the lever 60 the lever applies a downward force to the upper surface 54 of the switch 50 at the location 66 to actuate the switch.

The lever 60 has an upper portion 68 with an upper surface 70 engaging the lower surface 42 of the actuator 12. The upper surface 70 engages an edge portion 72 of the actuator 12 at an actuator engagement location 74 defined as the intersection of the edge portion and the upper surface 70. Upon tilting movement of the actuator 12 relative to the shaft 28 toward the switch 50, the actuator applies a downward force to the upper surface 70 of the lever 60 at the location 74 to pivot the lever to actuate the switch.

The lever 60 (FIG. 2) is mounted to the housing 14 or the PCB 24 for pivotal movement about a pivot axis 78. The lever 60 includes two pivot pins 80 (one of which is shown in FIG. 2). The pivot pins 80 extend into upwardly extending supports 84 of the housing 14. Accordingly, each lever 60 is supported by two supports 84. The supports 84 extend upwardly from a bottom portion 86 of the housing 14. Upon tilting of the actuator 12 toward a lever 60 relative to the shaft 28 of the encoder 26, the lever 60 pivots relative to the supports 84 to depress the upper surface 54 of the switch 50 and actuate the switch.

The pivot axis 78 (FIG. 3) is spaced vertically from the upper surface 54 of the switch 50 and the location 66 a first vertical distance D1 measured in a direction extending parallel to the central axis 52. The upper surface 70 of the lever 60 and the location 74 are spaced vertically from the upper surface 54 of the switch 50 a second vertical distance D2 greater than the first vertical distance D1. Accordingly, the axis 78 is located vertically between the upper surface 54 of the switch 50 and the upper surface 70 of the lever 60. Also, the axis 78 is located vertically between the switch engagement location 66 and the actuator engagement location 74.

The location 74 on the upper surface 70 of the lever 60 is spaced laterally in a direction extending perpendicular to the central axis 52 from the axis 78 a first lateral distance d1. The location 66 on the upper surface 54 of the switch 50 is spaced laterally from the axis 78 a second lateral distance d2 that is greater than the first lateral distance d1. Accordingly, the actuator engagement location 74 on the upper surface 70 is located laterally between the pivot axis 78 and the switch engagement location 66 on the upper surface 54 of the switch 50.

The relative spacing between the switch engagement location 66 and the pivot axis 78 results in a pivot radius of R1 for the switch engagement location 66. The relative spacing between the actuator engagement location 74 and the pivot axis 78 results in a pivot radius of R2 for the switch engagement location 74. The pivot radius R1 is larger than the pivot radius R2. The actuator 12 only needs to be tilted relative to the shaft 28 a small amount to actuate the switch 50. A relatively small amount of movement of the actuator engagement location 74 creates a relatively large movement of the switch engagement location 66.

Figure 4:
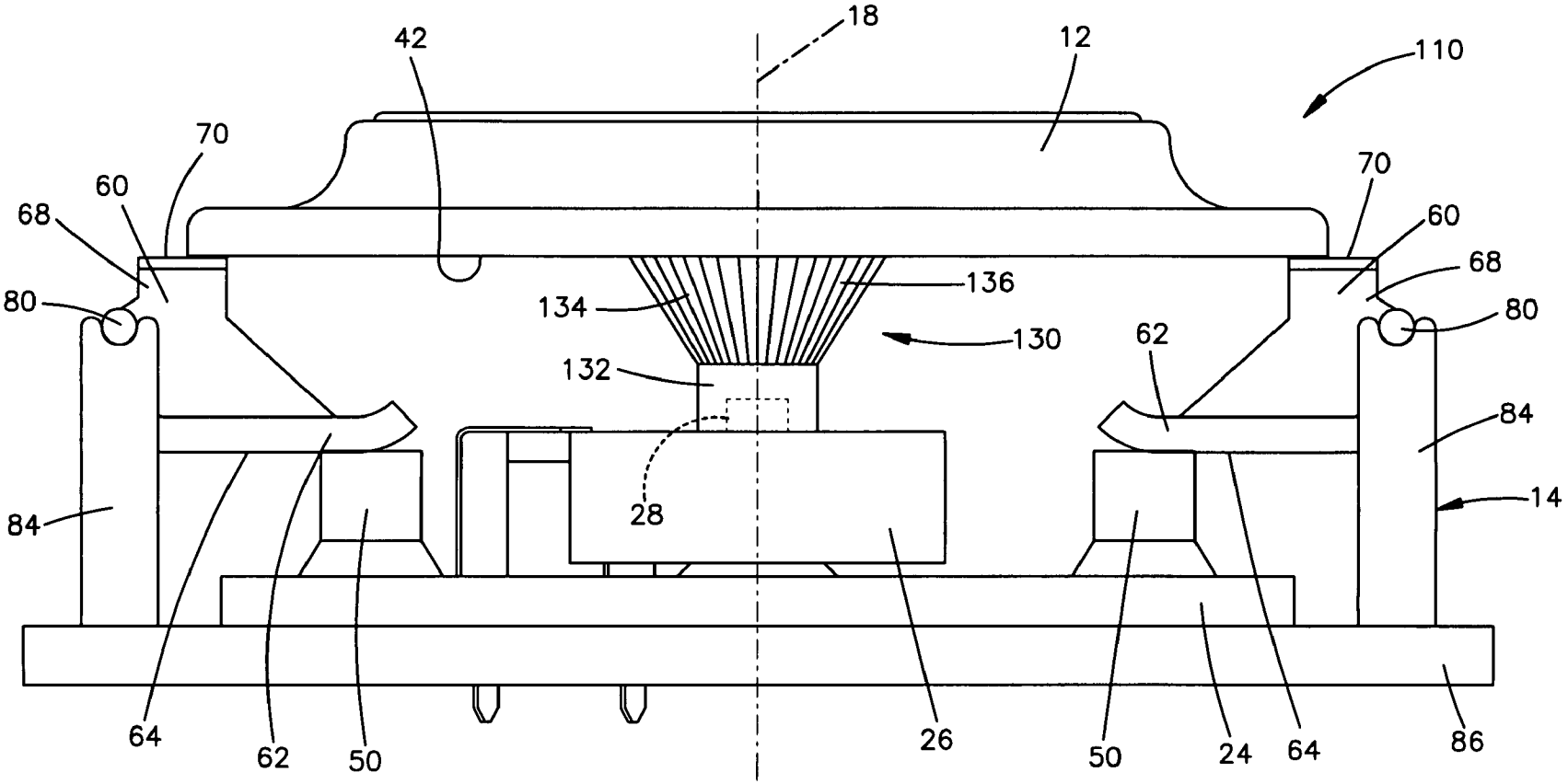
FIG. 4 is a schematic sectional view of a switch mechanism constructed in accordance with a second exemplary embodiment of the present invention.

A switch mechanism 110 constructed in accordance with a second exemplary embodiment of the present invention is illustrated in FIG. 4. The second exemplary embodiment is generally similar to the first exemplary embodiment except for a different connector assembly interconnecting the input shaft of the encoder and the actuator. Accordingly, similar numerals will be utilized to designate similar components.

The actuator 12 of the switch mechanism 110 is connected to the input shaft 28 of the encoder 26 by a resiliently flexible connector assembly 130. The connector assembly 130 transmits rotational movement of the actuator 12 about the axis 18 to the shaft 28 of the encoder 26 and permits tilting movement of the actuator relative to the axis 18 and the shaft 28. The connector assembly 130 is a one-piece hollow resiliently flexible elastic member having a first or lower cylindrical end portion 132 connected to the shaft 28 of the encoder 26. The lower end portion 132 may be connected to the shaft 28 in any desired manner, such as with a press fit.

A second or upper frustoconical end portion 134 of the connector assembly 130 is connected with the actuator 12. A lower end of the upper end portion 134 has a first outer diameter and an upper end of the upper end portion 134 has a second outer diameter larger than the first diameter. The upper end portion 134 is connected to the actuator 12. The upper end portion 134 may include ribs 136 extending from the actuator 12 to the lower end portion 132.

A portion of the upper end portion 134 that faces the switch 50 toward which the actuator 12 is tilted collapses upon tilting movement of the actuator toward the switch. A portion of the upper end portion 134 opposite the portion that collapses stretches to permit the actuator 12 to tilt relative to the shaft 28 of the encoder 22. Upon tilting movement of the actuator 12 relative to the shaft 28, the lever 60 pivots relative to the supports 84 to actuate the switch 50 in a manner similar to that described in connection with the embodiment of the FIGS. 1-3. The connector assembly 130 urges the actuator 12 into the initial position aligned with the axis 18.

Figure 5:
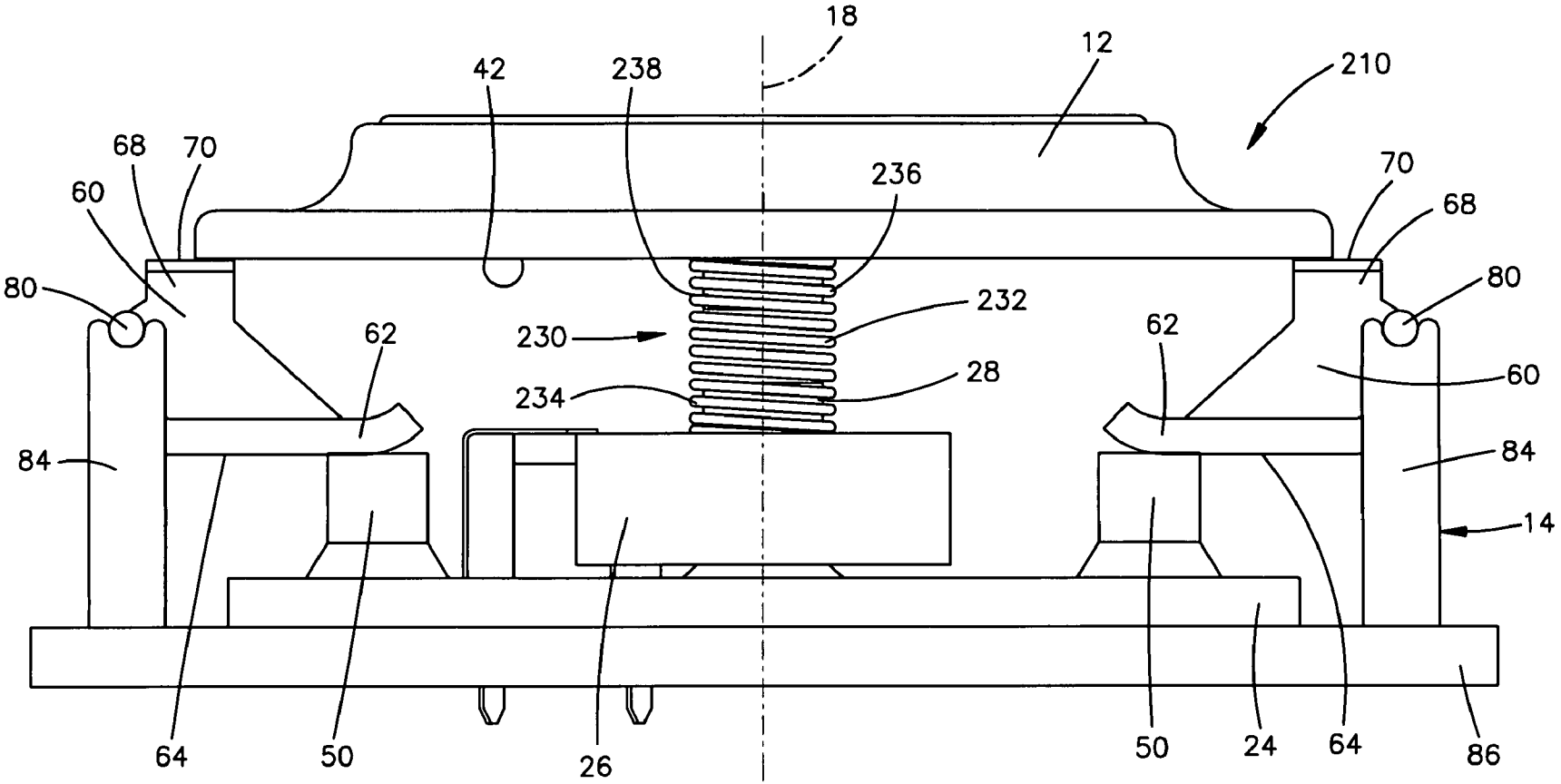
FIG. 5 is a schematic sectional view of a switch mechanism constructed in accordance with a third exemplary embodiment of the present invention.

A switch mechanism 210 constructed in accordance with a third exemplary embodiment of the present invention is illustrated in FIG. 5. The third exemplary embodiment is generally similar to the first exemplary embodiment except for a different connector assembly interconnecting the input shaft of the encoder and the actuator. Accordingly, similar numerals will be utilized to designate similar components.

The actuator 12 of the switch mechanism 210 is connected to the input shaft 28 of the encoder 26 by a resiliently flexible connector assembly 230. The connector assembly 230 transmits rotational movement of the actuator 12 about the axis 18 to the shaft 28 of the encoder 26 and permits tilting movement of the actuator relative to the axis 18 and the shaft 28. The connector assembly 230 has a one-piece spring 232 having a first or lower end portion 234 connected to the shaft 28 of the encoder 26. The lower end portion 234 may be connected to the shaft 28 in any desired manner, such as with a press fit.

A second or upper end portion 236 of the spring 232 is connected with the actuator 12. The upper end portion 236 may be press fit onto a shaft 238 extending from the lower surface 42 of the actuator 12. However, the upper end portion 236 may be connected to the actuator 12 in any desired manner.

A portion of the spring 232 facing the switch 50 toward which the actuator 12 is tilted collapses upon tilting movement of the actuator toward the switch. The portion of the spring 232 facing away from the switch stretches to permit the actuator 12 to tilt relative to the shaft 28 of the encoder 22. Upon tilting movement of the actuator 12 relative to the shaft 28, the lever 60 pivots relative to the supports 84 to actuate the switch 50 in a manner similar to that described in connection with the embodiment of the FIGS. 1-3. The spring 232 urges the actuator 12 into the initial position aligned with the axis 18.

From the above description of the invention, those skilled in the art will perceive improvements, changes and modifications. Such improvements, changes and modifications within the skill of the art are intended to be covered by the appended claims.

Having described the invention, we claim the following:

1. A switch mechanism comprising;

a support;

a plurality of switches connected to said support;

an encoder connected to said support, said encoder having a shaft rotatable about an axis of the shaft relative to said support, said encoder sending a signal in response to a sensed rotational position of said shaft about said axis relative to said support;

an actuator rotatable with said shaft about said axis of said shaft relative to said support and tiltable relative to said axis of said shaft to actuate any of said plurality of switches when said shaft is in any rotational position relative to said support;

a lever that is pivotal about a pivot axis and engageable by said actuator in order to actuate one of said plurality of switches, and a connector assembly interconnecting said actuator and said shaft, said connector assembly transmitting rotational movement of said actuator to said shaft and permitting tilting movement of said actuator relative to said axis.

2. A switch mechanism as set forth in claim 1 wherein one of said plurality of switches includes a dome switch having a central axis, an upper surface of said dome switch being movable to actuate said dome switch, said lever having a lower surface engaging said upper surface of said dome switch at a first location on said central axis of said dome switch, said actuator engaging an upper surface of said lever at a second location to pivot said lever toward said upper surface of said dome switch to actuate said dome switch, said pivot axis being spaced from said first location a first vertical distance extending parallel to the central axis of the dome switch, said second location being spaced from said first location a second vertical distance in a direction extending parallel to the central axis, said first distance being smaller than said second distance.

3. A switch mechanism as set forth in claim 2 wherein said first location is spaced laterally from said pivot axis a first lateral distance extending perpendicular to said central axis of said dome switch, said second location being spaced laterally from said pivot axis a second lateral distance smaller than said first lateral distance.

4. A switch mechanism as set forth in claim 2 wherein a first pivot radius extends from said pivot axis to said first location, a second pivot radius extends from said pivot axis to said second location, said second pivot radius being smaller than said first pivot radius.

5. A switch mechanism as set forth in claim 1 wherein said support is a printed circuit board.

6. A switch mechanism comprising;

a support;

a plurality of switches connected to said support;

an encoder connected to said support, said encoder having a shaft rotatable about an axis of the shaft relative to said support, said encoder sending a signal in response to a sensed rotational position of said shaft about said axis relative to said support;

an actuator rotatable with said shaft about said axis of said shaft relative to said support and tiltable relative to said axis of said shaft to actuate any of said plurality of switches when said shaft is in any rotational position relative to said support; and a connector assembly interconnecting said actuator and said shaft, said connector assembly transmitting rotational movement of said actuator to said shaft and permitting tilting movement of said actuator relative to said axis, wherein said connector assembly includes a first gear connected with said shaft and a second gear connected with said actuator, said first and second gears engaging each other to transmit rotation of said actuator to said shaft, said second gear moving relative to said first gear upon tilting of said actuator relative to said axis.

7. A switch mechanism as set forth in claim 6 wherein said first and second gears are coaxial.

8. A switch mechanism as set forth in claim 6 wherein said first gear has an opening into which said second gear extends.

9. A switch mechanism as set forth in claim 6 wherein said first and second gears include conical teeth.

10. A switch mechanism comprising;

a support;

a plurality of switches connected to said support;

an encoder connected to said support, said encoder having a shaft rotatable about an axis of the shaft relative to said support, said encoder sending a signal in response to a sensed rotational position of said shaft about said axis relative to said support;

an actuator rotatable with said shaft about said axis of said shaft relative to said support and tiltable relative to said axis of said shaft to actuate any of said plurality of switches when said shaft is in any rotational position relative to said support; and a connector assembly interconnecting said actuator and said shaft, said connector assembly transmitting rotational movement of said actuator to said shaft and permitting tilting movement of said actuator relative to said axis, said connector assembly including a first gear connected with said shaft and a second gear connected with said actuator, said second gear moving relative to said first gear upon tilting of said actuator relative to said axis, wherein said first gear has conical teeth defining an axially extending opening, said second gear having external conical teeth engaging said conical teeth of said first gear to transmit rotation of said actuator to said shaft.

11. A switch mechanism as set forth in claim 10 wherein a spring urges said conical teeth of said first and second gears into engagement with each other.

12. A switch mechanism as set forth in claim 11 wherein said spring permits portions of said conical teeth of said first and second gears to disengage from each other upon movement of said actuator relative to said shaft.

13. A switch mechanism comprising;

a support;

a plurality of switches connected to said support;

an encoder connected to said support, said encoder having a shaft rotatable about an axis of the shaft relative to said support, said encoder sending a signal in response to a sensed rotational position of said shaft about said axis relative to said support;

an actuator rotatable with said shaft about said axis of said shaft relative to said support and tiltable relative to said axis of said shaft to actuate any of said plurality of switches when said shaft is in any rotational position relative to said support; and a connector assembly interconnecting said actuator and said shaft, said connector assembly transmitting rotational movement of said actuator to said shaft and permitting tilting movement of said actuator relative to said axis, wherein said connector assembly includes a resiliently flexible member having a first axial end connected with said shaft and a second axial end connected with said actuator, said resiliently flexible member transmitting rotational movement of said actuator to said shaft and flexing upon tilting movement of said actuator relative to said axis.

14. A switch mechanism as set forth in claim 13 wherein said resiliently flexible member includes an elastomeric frustoconical portion.

15. A switch mechanism as set forth in claim 14 wherein said first axial end of said frustoconical portion has a first diameter and said second axial end has a second diameter larger than the first diameter.

16. A switch mechanism as set forth in claim 13 wherein said flexible member includes a spring.

17. A switch mechanism as set forth in claim 16 wherein said spring is a coil spring.

18. A switch mechanism comprising:

an actuator;

a switch having a central axis, an upper surface of said switch being movable to actuate said switch;

a lever pivotal about a pivot axis, said lever having a lower surface engaging said upper surface of said switch at a first location on said central axis, said actuator engaging an upper surface of said lever at a second location to pivot said lever toward said upper surface of said switch to actuate said switch, said pivot axis being spaced from said first location a first vertical distance extending parallel to the central axis of the switch, said second location being spaced from said first location a second vertical distance in a direction extending parallel to the central axis, said first distance being smaller than said second distance.

19. A switch mechanism as set forth in claim 18 wherein said first location is spaced laterally from said pivot axis a first lateral distance extending perpendicular to said central axis of said switch, said second location being spaced laterally from said pivot axis a second lateral distance smaller than said first lateral distance.

20. A switch mechanism as set forth in claim 19 wherein said switch mechanism further comprises a support, said switch being connected to said support, an encoder connected to said support having a shaft rotatable about an axis of the shaft relative to said support, said encoder sending a signal in response to a sensed rotational position of said shaft about said axis of said shaft relative to said support, an actuator rotatable with said shaft about said axis of said shaft relative to said support and tiltable relative to said axis of said shaft to actuate said switch, and a connector assembly interconnecting said actuator and said shaft, said connector assembly transmitting rotational movement of said actuator to said shaft and permitting tilting movement of said actuator relative to said axis.

21. A switch mechanism as set forth in claim 20 wherein said connector assembly includes a resiliently flexible member having a first axial end connected with said shaft and a second axial end connected with said actuator, said resiliently flexible member transmitting rotational movement of said actuator to said shaft and flexing upon tilting movement of said actuator relative to said axis.

22. A switch mechanism as set forth in claim 21 wherein said flexible member includes an elastomeric frustoconical portion, said first axial end of said frustoconical portion has a first diameter and said second axial end has a second diameter larger than the first diameter.

23. A switch mechanism as set forth in claim 22 wherein said flexible member includes a coil spring.

24. A switch mechanism as set forth in claim 19 wherein said first and second gears include conical teeth.

25. A switch mechanism as set forth in claim 19 wherein a first pivot radius extends from said pivot axis to said first location, a second pivot radius extends from said pivot axis to said second location, said second pivot radius being smaller than said first pivot radius.

26. A switch mechanism as set forth in claim 18 wherein said connector assembly includes a first gear connected with said shaft and a second gear connected with said actuator, said first and second gears engaging each other to transmit rotation of said actuator to said shaft, said second gear moving relative to said first gear upon tilting of said actuator relative to said axis of said shaft.

27. A switch mechanism as set forth in claim 18 wherein said switch is a dome switch.

28. A switch mechanism comprising:

an actuator;

a switch having a central axis, an upper surface of said switch being movable to actuate said switch; and a lever pivotal about a pivot axis, said lever having a lower surface engaging said upper surface of said switch at a first location on said central axis, said actuator engaging an upper surface of said lever at a second location to pivot said lever toward said upper surface of said switch to actuate said switch, said pivot axis being spaced from said first location a first vertical distance extending parallel to the central axis of the switch, said second location being spaced from said first location a second vertical distance in a direction extending parallel to the central axis, said first distance being smaller than said second distance;

said first location being spaced laterally from said pivot axis a first lateral distance extending perpendicular to said central axis of said dome switch, said second location being spaced laterally from said pivot axis a second lateral distance smaller than said first lateral distance;

wherein said first gear has conical teeth defining an axially extending opening, said second gear having external conical teeth engaging said conical teeth of said first gear.

29. A switch mechanism as set forth in claim 28 wherein a spring urges said conical teeth of said first and second gears into engagement with each other.

* * * * *